US011391503B2

(12) United States Patent
Scully, Jr. et al.

(10) Patent No.: US 11,391,503 B2
(45) Date of Patent: Jul. 19, 2022

(54) ROTATING PUMP MOUNT AND SUPPORT FOR TRANSPORTATION ENCLOSURE

(71) Applicant: Thaddeus Medical Systems, Inc., Rochester, MN (US)

(72) Inventors: Stephen Joseph Scully, Jr., Rochester, MN (US); Derek Pfeffer, Rochester, MN (US); Russell Sanders, Minnetonka, MN (US)

(73) Assignee: Thaddeus Medical Systems, Inc., Rochester, MN (US)

( * ) Notice: Subject to any disclaimer, the term of this patent is extended or adjusted under 35 U.S.C. 154(b) by 203 days.

(21) Appl. No.: 16/829,618

(22) Filed: Mar. 25, 2020

(65) Prior Publication Data

US 2020/0309442 A1 Oct. 1, 2020

Related U.S. Application Data

(60) Provisional application No. 62/824,127, filed on Mar. 26, 2019.

(51) Int. Cl.

| | |
|---|---|
| ***F25D 11/00*** | (2006.01) |
| ***F28F 9/013*** | (2006.01) |
| ***F28D 21/00*** | (2006.01) |

(52) U.S. Cl.

CPC ..... *F25D 11/003* (2013.01); *F28D 21/00* (2013.01); *F28F 9/0137* (2013.01); *F28D 2021/0019* (2013.01)

(58) Field of Classification Search

CPC ..... F25D 11/003; F25D 23/006; F28D 21/00; F28D 2021/0019; F28F 9/0137; F04B 53/16

USPC ..... 165/173

See application file for complete search history.

(56) References Cited

U.S. PATENT DOCUMENTS

| | | | | |
|---|---|---|---|---|
| 5,810,322 | A * | 9/1998 | Zhao | F25D 23/006 248/606 |
| 7,168,260 | B2 * | 1/2007 | Lee | F25D 23/006 62/297 |
| 10,072,887 | B2 * | 9/2018 | Lokhande | F25D 21/14 |
| 2005/0252208 | A1 * | 11/2005 | Yoshida | F25D 23/006 60/520 |
| 2008/0006497 | A1 * | 1/2008 | Athanasiou | F16F 15/046 188/379 |
| 2015/0047383 | A1 * | 2/2015 | Hong | F25D 23/006 62/296 |
| 2015/0338141 | A1 * | 11/2015 | Troxell | F25D 23/006 62/77 |
| 2017/0268493 | A1 * | 9/2017 | Maier | F04B 39/14 |
| 2018/0112908 | A1 * | 4/2018 | Song | F25D 23/006 |
| 2019/0285333 | A1 * | 9/2019 | Lesko | F25B 31/00 |

* cited by examiner

*Primary Examiner* — Jon T. Schermerhorn, Jr.
(74) *Attorney, Agent, or Firm* — Schwegman Lundberg & Woessner, P.A.

(57) ABSTRACT

A pump mount for a product transportation and storage enclosure can include a stationary bracket secured to one or more of the walls of the housing, a rotating bracket configured to support the pump, a pump manifold, and a rotating manifold.

12 Claims, 10 Drawing Sheets

ROTATING PUMP MOUNT AND SUPPORT FOR TRANSPORTATION ENCLOSURE

CLAIM OF PRIORITY

This patent application claims the benefit of priority, under 35 U.S.C. Section 119(e), to Stephen J. Scully Jr. U.S. Patent Application Ser. No. 62/824,127, entitled "ROTATING PUMP MOUNT AND SUPPORT FOR TRANSPORTATION ENCLOSURE," filed on Mar. 26, 2019, each of which is hereby incorporated by reference herein in its entirety.

BACKGROUND

The present disclosure relates generally to transportation devices for temperature sensitive items. In various circumstances, temperature sensitive products may require transportation. For example, vials of a vaccine or tubes of blood require transport between medical facilities and/or laboratories. Some of the products requiring transport can be damaged by relatively extreme ambient conditions such as high or low temperatures. Such products therefore require a transportation enclosure capable of actively or passively maintaining a temperature range of the product within the enclosure.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

The patent or application file contains at least one drawing executed in color. Copies of this patent or patent application publication with color drawing(s) will be provided by the Office upon request and payment of the necessary fee.

DETAILED DESCRIPTION

To accommodate transportation of temperature sensitive items, containers having passive or active temperature control can be used. Some transportation enclosures can use active cooling to maintain an internal temperature of the enclosure during transportation of the fluids where ambient air can be used to cool one or more cavities within the enclosure and forced convection can be used to transfer heat between the fluids and the ambient environment. However, the use only ambient may be insufficient to maintain a desired product temperature within the enclosure due to extreme ambient conditions.

The techniques of this disclosure can help provide a solution to these issues such as through use of an active cooling or heating system. The heating/cooling system can be a transportable refrigeration system that includes a coil positioned to surround a product carrier, allowing a temperature of the carrier and products therein to be maintained at a setpoint temperature or within a desired range of temperatures. The heating/cooling system can also include a pump mount that allows for rotation of the pump with respect to a housing of the enclosure, which can help ensure the pump operates efficiently during transportation of the enclosure. The rotating pump mount can also help prevent oil return issues and oil starvation problems when the pump is a refrigerant compressor or a pump otherwise requiring oil.

The techniques of this disclosure can also help provide a solution to the problem of shock and forces transmitted to the cooling system and products within the enclosure by including shock absorbing pillars or supports placed within the enclosure. The supports can be positioned to provide structure sufficient to support a product carrier and products while also providing integral flow channels configured to promote airflow within the enclosure, such as during natural and/or forced convection. Further, because the supports may be relatively light weight, the supports may help reduce an overall weight of the enclosure. Though lightweight, the supports can be relatively high strength to help absorb shock and vibration (such as caused by drop) to limit transfer of the forces to products and components within the carrier.

Figure 1:
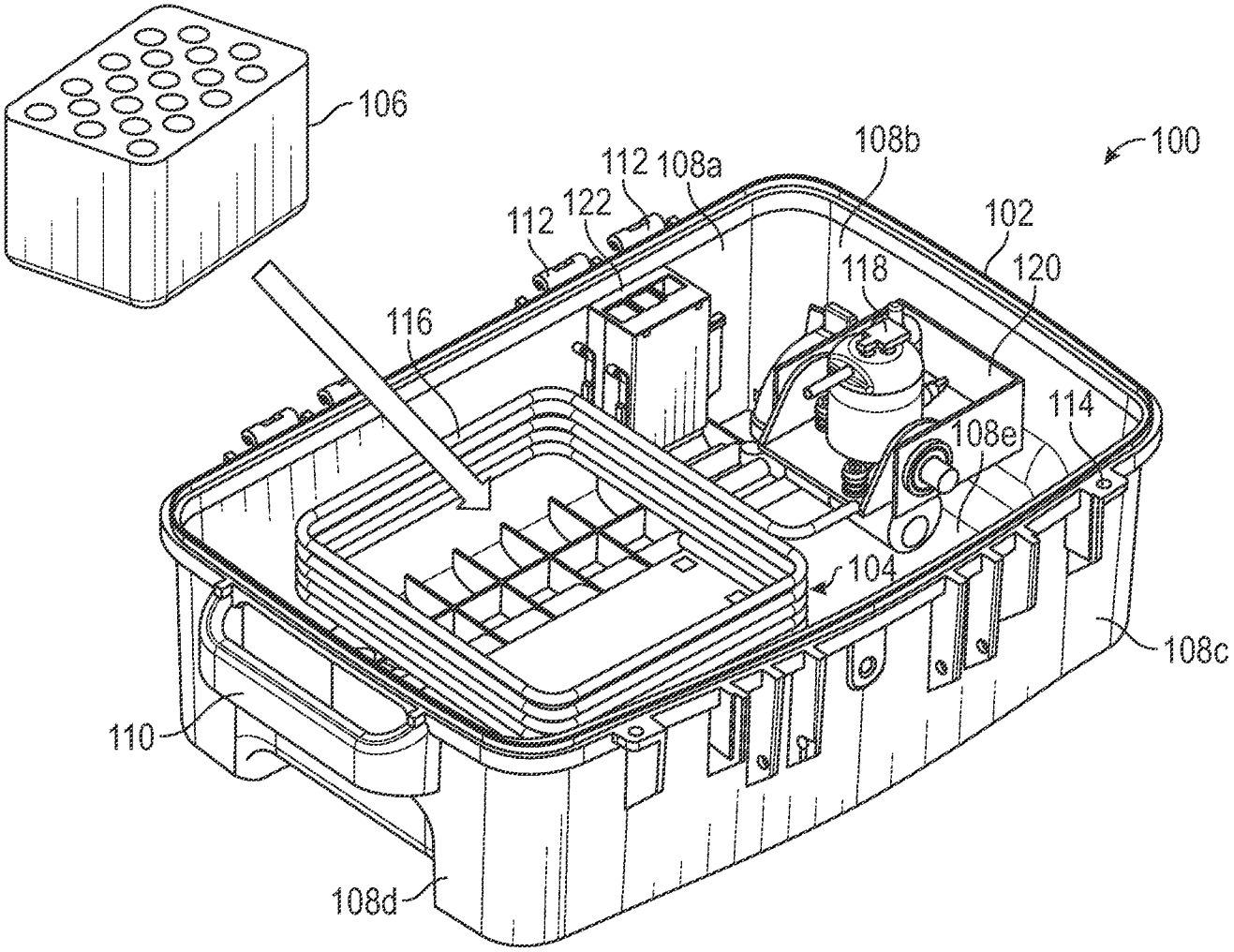
FIG. 1 illustrates a top isometric view of a transportation enclosure, in accordance with at least one example of this disclosure.

FIG. 1 illustrates an exploded view of a transportation enclosure 100, in accordance with at least one example of this disclosure. The transportation enclosure 100 can include a housing 102, a cooling system 104, and a product carrier 106. The housing 102 can include walls 108*a*-108*e*, handles 110 (only one handle is visible in FIG. 1), hinges 112, and fasteners 114. The cooling system 104 can include a heat exchanger 116, a compressor 118, and a pump mount 120. The transportation enclosure 100 can also include power and control modules 122.

The components of the transportation enclosure 100 can be made of one or more of metals, plastics, foams, elastomers, ceramics, composites, combinations thereof, or the like. Many of the components of the enclosure 100 can be made of insulative materials, such as one or more of plastics, foams, or the like to help maintain a desired temperature within the enclosure 100.

The housing 102 can be a support structure configured to releasably secure one or more tubes, vials, specimen containers, various medical products, or the like. The housing 102 can be at least partially formed by the walls 108*a*-108*e*, which can form a substantially rectangular compartment. The housing 102 can have other shapes in other examples. The transportation enclosure 100 can include a lid, which can be an insulative lid configured to enclose one or more sides of the enclosure 100. The lid can be releasably securable to the housing 102 via interference fit or other temporary locking interface such as through use of fasteners 114, of which there can be 1, 2, 3, 4, 5, 6, 7, 8, 9, 10, or the like. The lid can also be secured to the housing 102 through the hinges 112, of which there can be 1, 2, 3, 4, 5, 6, 7, 8, 9, 10, or the like. The hinges 112 can be secured to complimentary hinges of the lid to form a hinge between the lid and the housing 102 for repeatable opening of the lid such as for access to contents of the housing 102. The handles 110 can be connected to or integrated with the walls 108 and can be configured to be grasped for carrying of the enclosure 100.

The cooling system 104 can be a cooling and/or heating system configured to provide heating and/or cooling to one or more components within the housing 102, such as the product carrier 106 and the contents thereof. The heating/cooling system 104 can be a liquid circulation cooling/heating, a vapor compression cycle cooling system, or a heatpump vapor compression cycle system using, for example refrigerant. In some examples, the system 104 can be only a heating device or only a cooling device, depending on the requirements of the contents of the enclosure 100. In some examples, the heating/cooling system 104 can be one or more thermoelectric devices (such as Peltier coolers).

The heat exchanger 116 can be supported by the housing 102 and in fluid communication with the pump 118 and an ambient environment (i.e. outside of the housing 102) via a second heat exchanger. In some examples, the heat exchanger 116 can be a coil configured to surround the product carrier 106 and, during operation, to heat and/or cool the product carrier 106 and the products therein. The heat exchanger 116 can include fins in some examples to increase thermal performance of the heat exchanger 116. The heat exchanger 116 can be comprised of materials having a relatively high heat transfer coefficient to improve heat transfer between fluid within the heat exchanger 116 and the product carrier 106, such as one or more of copper, aluminum, silver, steel, or the like.

The pump 118 can be a fluid pump (such as a water or glycol pump) configured to pump fluid through a closed circuit and between heat exchangers, such as the heat exchanger 116. The pump 118 can be a can be a positive displacement or rotary pump, such as a centrifugal pump configured to pump fluid. In some examples, the pump 118 can be a compressor, such as a refrigerant compressor configured to compress and motivate refrigerant gas (such as R-134a, R-410A, R-22, R-407C, or R-404A).

The pump mount 120 can be one or more brackets or pieces of hardware securable to the housing 102 and the pump 118 where the pump mount 120 can secure the pump 118 to the housing 102. As discussed below, the pump mount 120 can include one or more components that allow for rotation of the pump 118 with respect to the housing. Such rotation can help avoid issues with pumping performance (and oil management for compressors) for the pump 118 during transportation, such as when the housing 102 is rotated with respect to a direction of gravity. That is, when the housing 102 is not level.

The power supply and control modules 122 can include a battery and circuitry configured to provide power to the cooling system 104 during transportation of the enclosure 100. The power supply can be rechargeable in some examples. The control modules 122 can also include one or more devices for controlling operation of components of the enclosure 100, such as one or more temperature sensors, the cooling system 104, and/or a controller. The control modules 122 can be connected to the heating/cooling system 104 to distribute power to the heating/cooling system 104 and to control the operation of the heating/cooling system 104, such as fans and the pump 118. The control modules 122 can include a programable controller, such as a single or multi-board computer, a direct digital controller (DDC), or a programable logic controller (PLC). In other examples the controller can be any computing device, such as a handheld computer, for example, a smart phone, a tablet, a laptop, a desktop computer, or any other computing device including a processor and wireless communication capabilities.

In operation of some examples, tubes, products, or samples can be placed in the product carrier 106 and the lid can be secured to the housing 102. A controller (such as the controller of the modules of FIG. 1) can determine a temperature within the cavity housing 102 and/or of the tubes products within the carrier 106 and can determine if the temperature(s) are within a desired temperature range. When heating or cooling is needed to maintain the temperature within the housing 102, the heating/cooling system 104 can be enabled.

Fans can be used to deliver ambient air to intake ducts or louvers for an exchange of heat with the ambient environment (such as through a condenser or heat rejection coil) and the pump 118 can be operated to circulate a fluid through the cooling system, allowing the product to be cooled or heated by the heat exchanger 116. The pump 118 can be operated as necessary to heat or cool the products within the carrier 106 to maintain the temperature at desired temperature set point or within a desired temperature range. During transportation of the enclosure 100, the pump 118 is able to rotate on the pump mount 120 with respect to the housing 102 to help promote efficient operation of the pump 118 during transportation of the enclosure 100.

Figure 2A:
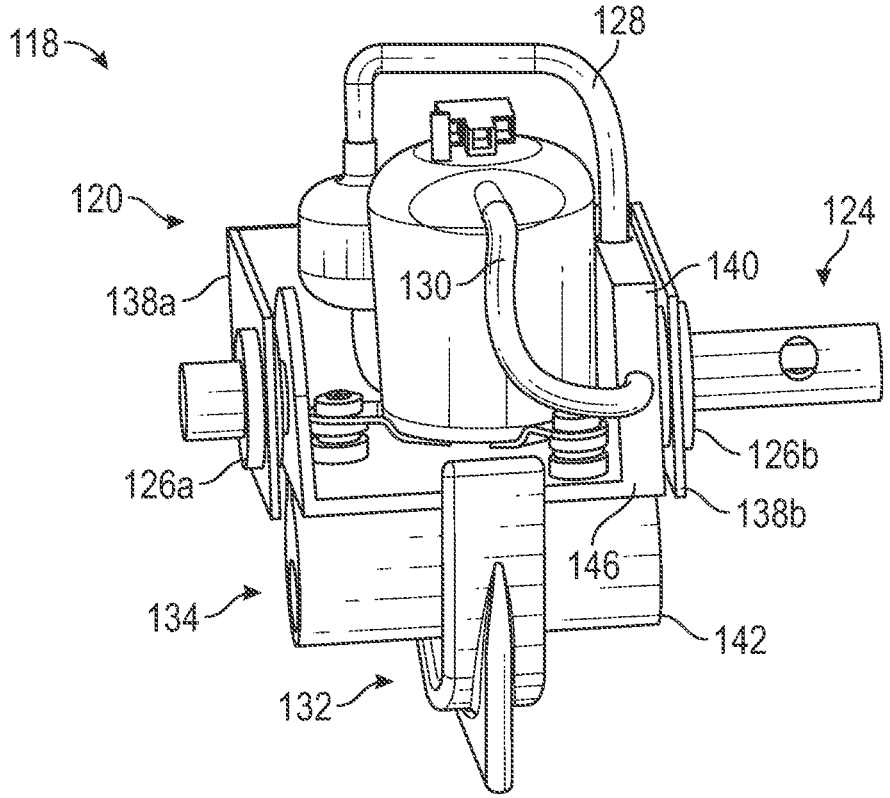
FIG. 2A illustrates a front isometric view of a pump and a pump mount, in accordance with at least one example of this disclosure.
Figure 2B:
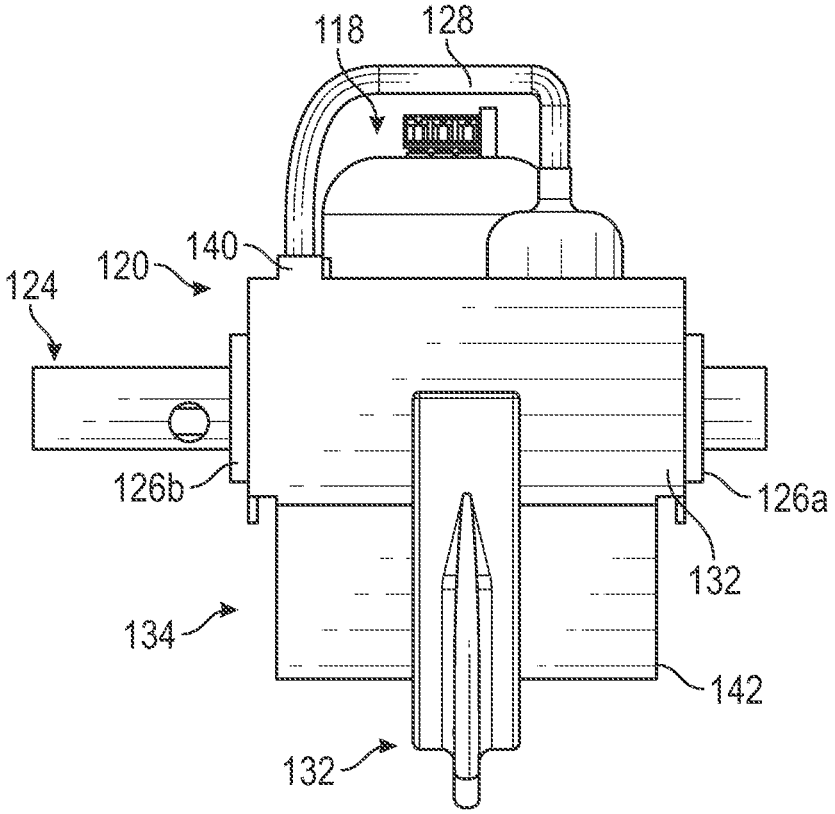
FIG. 2B illustrates a rear isometric view of a pump and a pump mount, in accordance with at least one example of this disclosure.
Figure 2C:
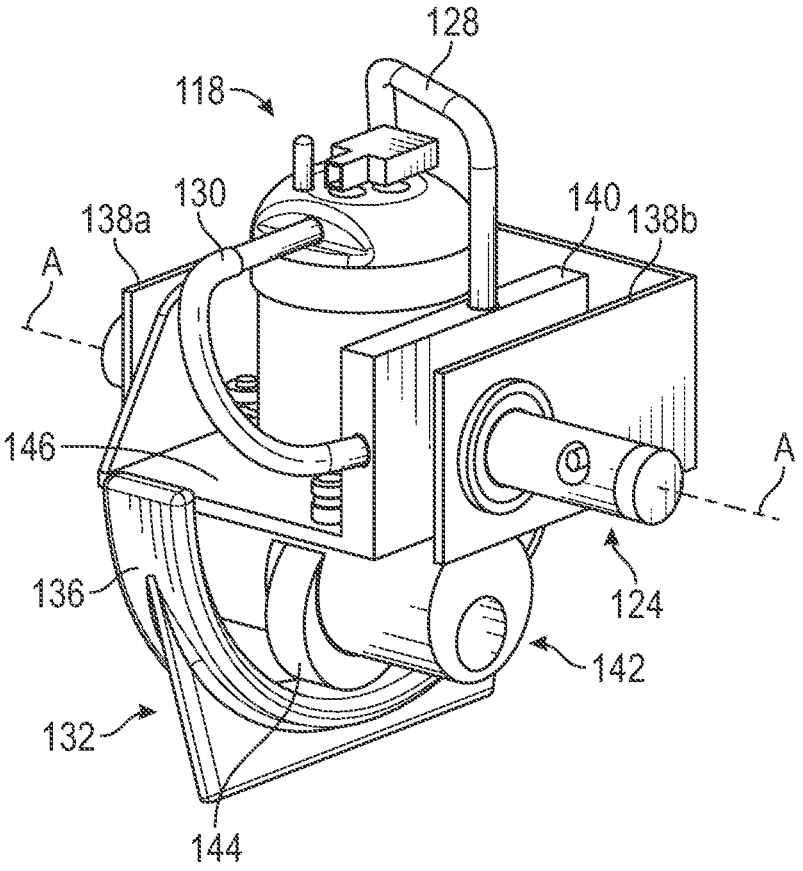
FIG. 2C illustrates a side isometric view of a pump and a pump mount, in accordance with at least one example of this disclosure.

FIG. 2A illustrates a front isometric view of the pump 118 and the pump mount 120, in accordance with at least one example of this disclosure. FIG. 2B illustrates a rear isometric view of the pump 118 and the pump mount 120, in accordance with at least one example of this disclosure. FIG. 2B illustrates a side isometric view of the pump 118 and the pump mount 120, in accordance with at least one example of this disclosure. FIGS. 2A-2C are discussed below concurrently.

Also shown in FIGS. 2A, 2B, and 2C are a pump manifold 124, bearings 126*a* and 126*b*, a suction line 128, a discharge line 130, a stationary bracket 132, and a rotating bracket 134. The stationary bracket 132 can include a race 136 and arms 138*a* and 138*b*. The rotating bracket 134 can include an integrated manifold 140, an overbalance 142, a wheel 144, and a platform 146. Also shown in FIG. 2C is rotational axis A.

The pump manifold 124 can be a pipe or rod including suction and discharge bores and ports (as discussed below) and can connect to the suction line 128 and the discharge line 130 of the pump 118 (in some examples via the integrated manifold 140). The pump manifold 124 can be connected to the platform 146 (or components connected thereto) and can therefore be configured to rotate with the platform 146 and the pump 118 about the rotational axis A (FIG. 2C) defined by the pump manifold 124. The bearings 126*a* and 126*b* can be secured to the arms 138 and the pump manifold 124 to create rotational bearings to allow for relatively low friction rotation of the pump manifold 124 with respect to the stationary bracket 132.

The suction line 128 and the discharge line 130 can be a suction and discharge line, respectively of the pump 118 and can be made of rigid or semi-rigid materials configured to transmit pressurized fluid therethrough.

The stationary bracket 132 can be a rigid or semi-rigid bracket secured to one or more of the walls of the housing 102 and the rotating bracket 134 can be a rigid or semi-rigid bracket supported by the pump manifold 124 and configured to support the pump 118 thereon. The pump 118 can be releasably securable to the platform 146 of the rotating bracket 134. In some examples, the platform 146 can be substantially planar.

The race 136 can be a stationary portion of the stationary bracket 132 extending at least partially around the rotational axis A. The race 136 can be positioned and configured to engage the wheel 144.

The integrated manifold 140 can be integrated with the platform 146 or can be connected thereto and therefore rotatable with the rotating bracket 134 and the pump 118. The integrated manifold 140 can include suction and discharge lines therein connecting to the suction and discharge bores of the pump manifold 134 to allow the suction line 128 and the discharge line 130 to be connected to the pump manifold 124 (and to separate respective suction and discharge lines).

The overbalance 142 can be a weight or mass suspended from a bottom portion of the platform 146. In some examples, the weight or mass of the overbalance 142 can have a center of gravity below the rotational axis A when the platform 146 is in a resting position. In some examples, the weight or mass of the overbalance 142 can be positioned entirely below the rotational axis A when the platform 146 is in a resting position. The wheel 144 can extend from the overbalance 142 (or from a portion of the rotating bracket 134) and can be rotatable relative thereto.

In operation of some examples, the rotating bracket 134, pump 118, suction line 128, discharge line 130, and pump manifold 124 can rotate with respect to the stationary bracket 132 and therefore relative to the housing 102 to allow the pump 118 to maintain a desired orientation with respect to the direction of the gravitational force, which can help allow the pump 118 to operate efficiently and can help prevent oil return and delivery issues caused by rotation of the pump with respect to the gravitational force. The overbalance 142 can help to orient the pump 118 with respect to gravity.

Though rotation of the pump 118 to maintain orientation with respect to a direction of gravity is desired, it is also preferable to minimize over-rotation of the pump 118 due to forces applied to the enclosure 100. During rotation of the pump 118 the race 136 can be engageable with the wheel 144 to dampen movement of the rotating bracket 134 (and therefore the pump 118) relative to the stationary bracket 132 to help reduce over-rotation of the pump 118 about the central axis.

Figure 3:
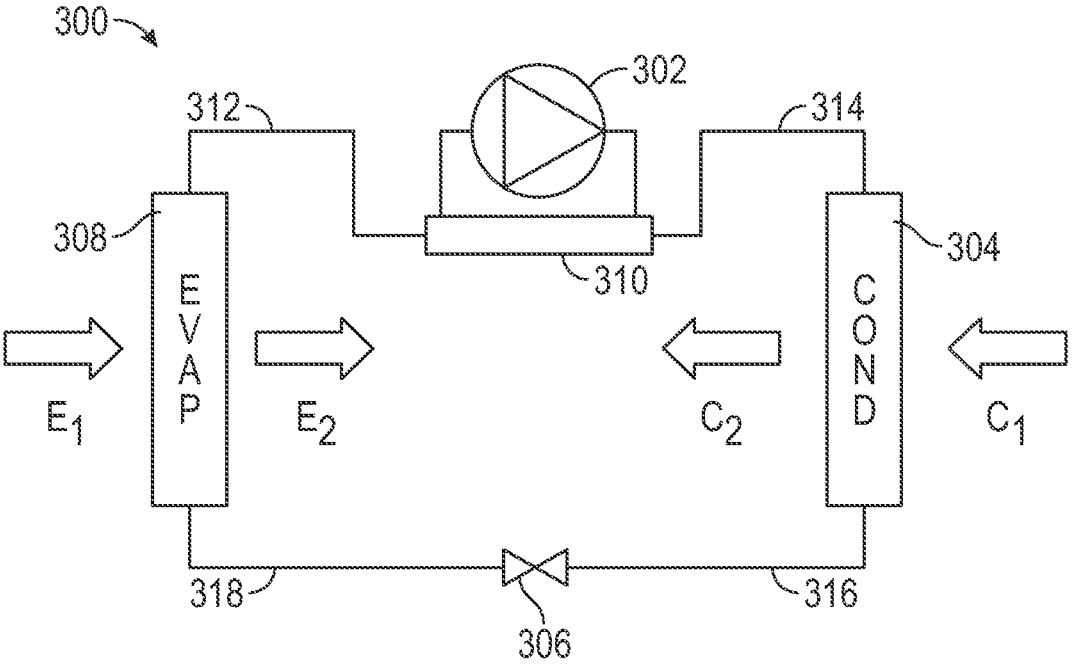
FIG. 3 illustrates a schematic view a cooling system, in accordance with at least one example of this disclosure.

FIG. 3 illustrates a schematic view of a cooling system 300, in accordance with at least one example of this disclosure. The cooling system 300 can include a compressor 302, a condenser 304, an expansion device 306, an evaporator 308, a compressor manifold 310 (or pump manifold 310), a suction line, and a discharge line 314, a liquid line 316, and a distributor line 318. Also shown in FIG. 3 are condenser entering air C1, condenser leaving air C2, evaporator entering air E1, and evaporator leaving air E2.

The suction line 312, the discharge line 314, the liquid line 316, and the distributor line 318 can be tubes, pipes, conduits, or the like, that are capable of conveying refrigerant through the refrigeration system 300 within the operating pressures and temperatures regularly seen in refrigeration systems.

The compressor 302 can be a positive displacement refrigerant compressor, such as a scroll compressor, a reciprocating compressor, a rotary compressor, or the like. The compressor 302 can be configured to pump various refrigerants, such as R-134a, R-410A, R-22, R-407C, R-404A, or the like. The evaporator 308 and the condenser 310 can be coils configured to exchange heat between refrigerant and air, such as plain tube coils, tube and fin coils, microchannel coils, or the like. The expansion device 306 can be a fixed orifice expansion device, such as a capillary tube, metering piston, or the like, or can be a thermal expansion valve (or an electronic expansion valve) configured to expand a liquid refrigerant.

In operation, the cooling system 300 can function consistently with vapor compression cycle systems known the art, where: the compressor 302 receives relatively cold gas refrigerant from the evaporator 308 via the suction line 312; the compressor discharges hot refrigerant gas to the discharge line 314 for delivery to the condenser coil 304; the condenser coil 304 can use the condenser incoming air C1 to condense the refrigerant and can discharge hot exhaust condenser air C2 and deliver hot liquid refrigerant through the liquid line 316 to the expansion valve 306; the expansion valve 306 can cool the liquid refrigerant by expanding it into a cool liquid gas mixture for delivery to the evaporator coil 208 via the distributor line 318; and, the evaporator coil 308 can use the cool refrigerant to cool the incoming evaporator air E1 using the cool refrigerant to discharge relatively cooler air E2 and to discharge superheated low pressure refrigerant gas to the compressor 302.

The cooling system 300 can differ from other cooling systems in that it includes the compressor manifold 310, which can connect to the suction line 312 and to the discharge line 314 such that suction gas flows through the compressor manifold 310 independently of (in fluid isolation from) the discharge gas, which also travels through the compressor manifold 310. The compressor manifold 310 can be used to help allow for rotation of the compressor 302 and the compressor manifold 310 with respect to other components of the cooling system 300, such as the evaporator 308, the condenser 304, the expansion valve 306, and the refrigerant lines (312, 314, 316, and 318).

In some examples, the cooling system 300 can be a reversible heat pump system where the flow of refrigerant can be reversed by the compressor 302 (or another component) and the evaporator 308 can become the condenser and the condenser 304 can become the evaporator. Though the cooling system 300 is shown and described as being a refrigeration system, the cooling system 300 can also be a liquid, water, or glycol cooling system where the compressor 302 is a pump and the expansion valve 306 is optionally omitted.

Figure 4A:
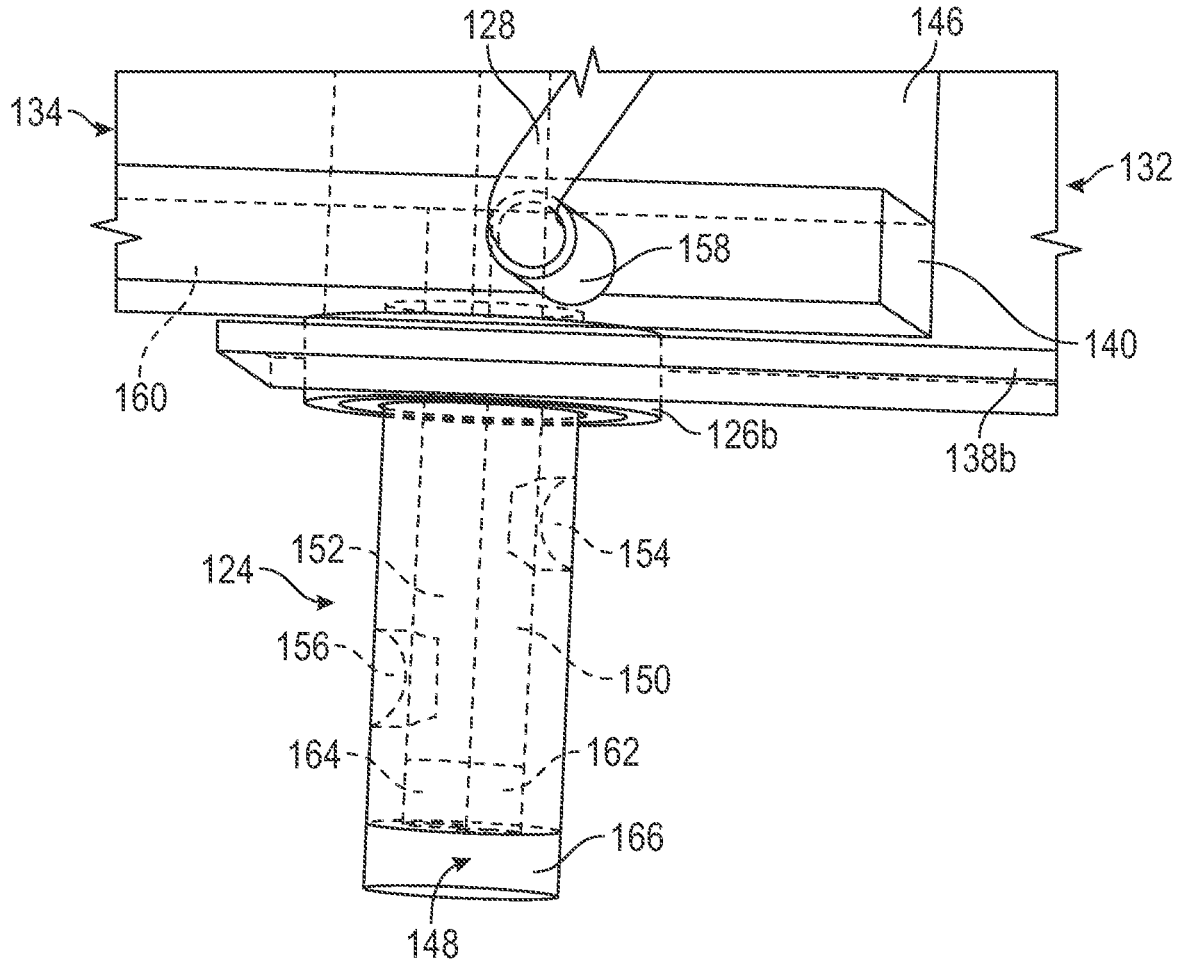
FIG. 4A illustrates a top view of a portion of a pump mount, in accordance with at least one example of this disclosure.
Figure 4B:
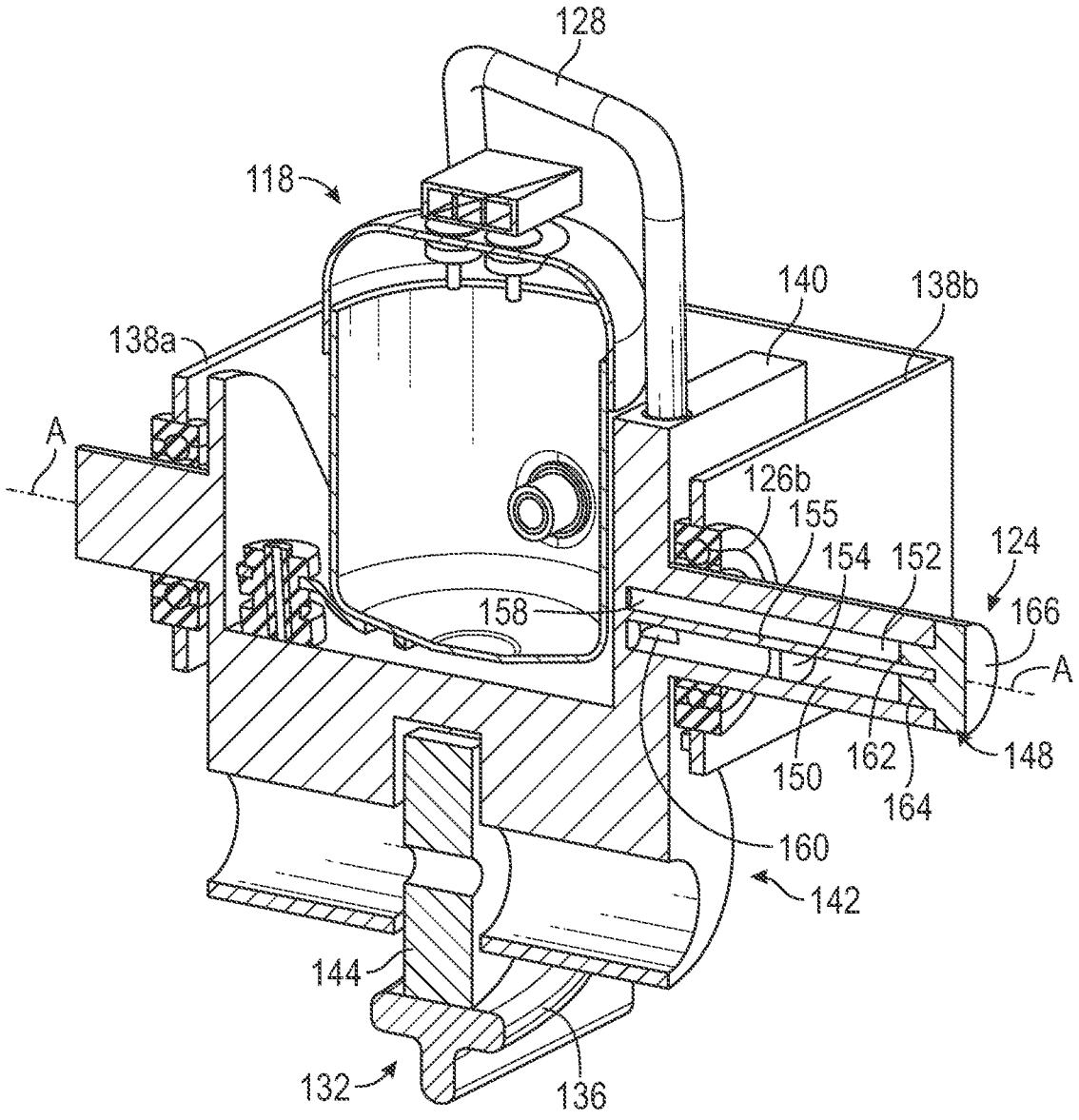
FIG. 4B illustrates a cross-sectional view of a portion of a pump mount, in accordance with at least one example of this disclosure.

FIG. 4A illustrates a top view of a portion of the pump mount 120, in accordance with at least one example of this disclosure. FIG. 4B illustrates a cross-sectional view of a portion of the pump mount 120, in accordance with at least one example of this disclosure. FIGS. 4A and 4B are discussed below concurrently.

The components of FIGS. 4A-4B can be consistent with those of FIGS. 1-2C; FIGS. 4A-4B shows additional details of such components. For example, FIGS. 4A-4B show how the pump manifold 124 can include a plug 148, a suction bore 150, a discharge bore 152, a suction port 154, and a discharge port 156.

The suction bore 150 and the discharge bore 152 can each extend from an end of the pump manifold 124 into the integrated manifold 140 where the suction bore 150 and the discharge bore 152 can be fluidly isolated from each other within the pump manifold 124 by a wall 155 (shown in FIG. 4B). The suction port 154 can be a bore extending from an outer surface of the pump manifold 124 and into the pump manifold 124 to intersect with the suction bore 150. Similarly, discharge port 156 can be a bore extending from an outer surface of the pump manifold 124 and into the pump manifold 124 to intersect with the discharge bore 152. The suction port 154 and the discharge port 156 can be on opposite, or substantially opposite, sides (diametrically opposite sides) of the pump manifold 124 for connection to a rotating manifold (shown and discussed in FIG. 6 below).

FIGS. 4A and 4B also show that the integrated manifold 140 can include a suction bore 158 and a discharge bore 160. The suction bore 158 of the integrated manifold 140 can connect to the suction bore 150 of the pump manifold 124. Similarly, the discharge bore 160 of the integrated manifold 140 can connect to the discharge bore 152 of the pump manifold 124.

FIGS. 4A-4B also show how the plug 148 can include a suction boss 162 and a discharge boss 164 that can extend respectively from a base 166 of the plug 148. When the plug 148 is secured to an end of the pump manifold 124, the suction boss 162 can extend into the suction bore 150 and the discharge boss 164 can extend into the discharge bore 152 to limit flow through the end of the pump manifold 124 and to help promote flow through the suction port 154 and the discharge port 156. By using the plug 148 to close the suction bore 150 and the discharge bore 152, a cost to produce the pump manifold 124 can be reduced because drilling operations to create the suction bore 150 and the discharge bore 152 can be simpler (drilling through the end of the pump manifold 124).

FIGS. 4A-4B also show how the bearing 126*b* can receive the pump manifold 124 therein and how the bearing 126*b* can be secured within a bore of the arm 138*b* to create a rotating interface between the pump manifold 124 and the stationary bracket 132.

Figure 5:
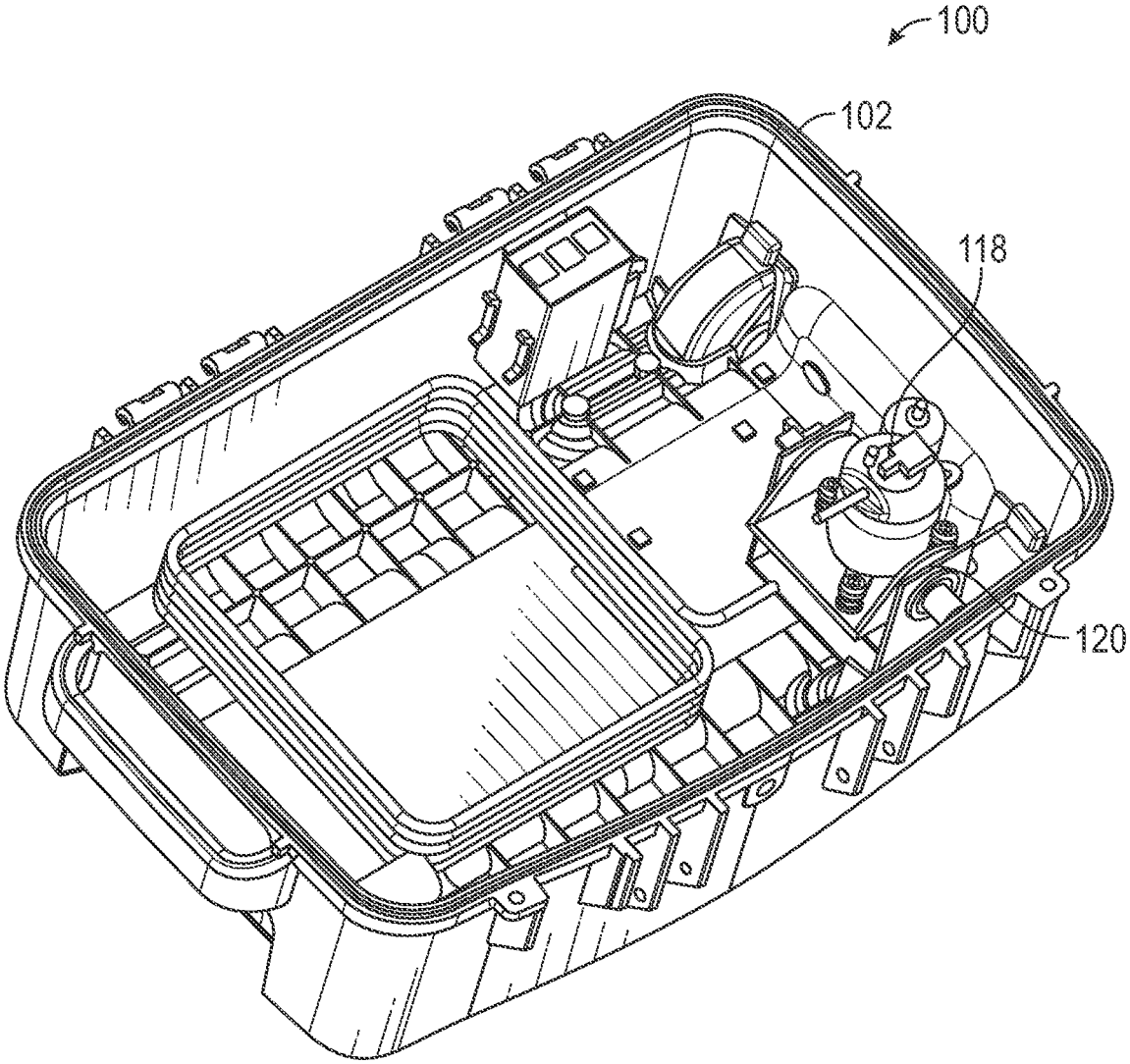
FIG. 5 illustrates a top isometric view of a transportation enclosure, in accordance with at least one example of this disclosure.

FIG. 5 illustrates a top isometric view of a transportation enclosure, in accordance with at least one example of this disclosure. FIG. 5 shows an alternative view of the enclosure 100 and its components.

Figure 6:
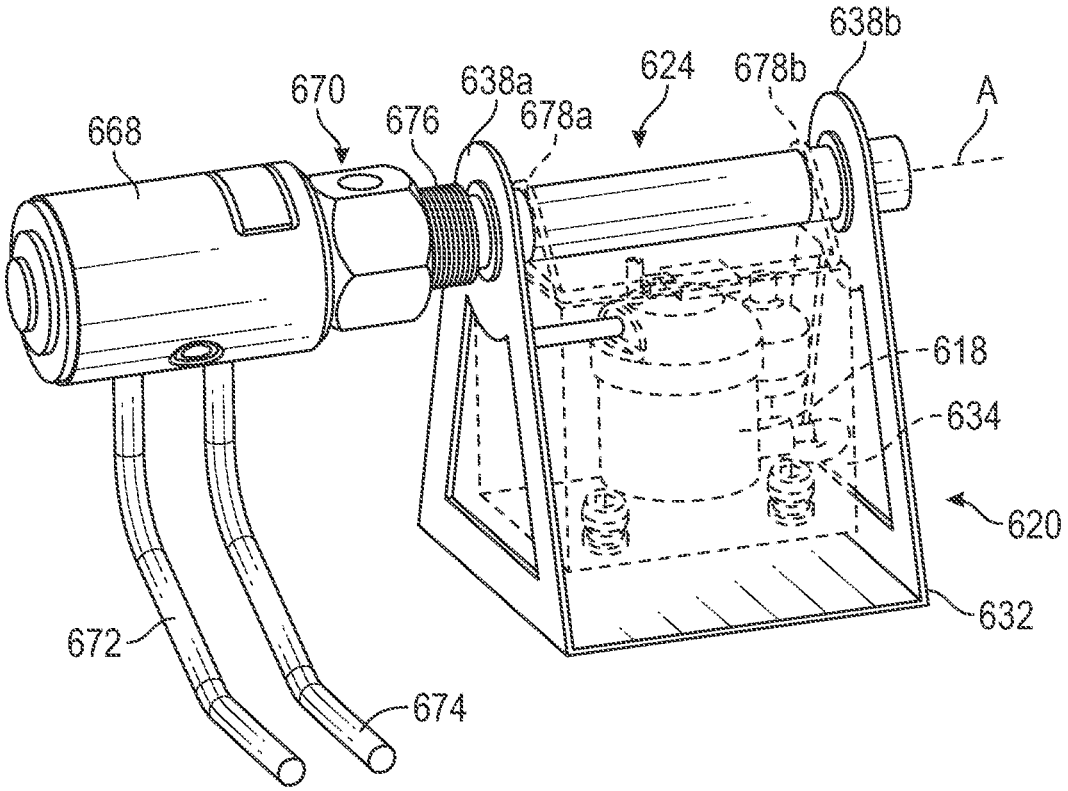
FIG. 6 illustrates a front isometric view of a pump and a pump mount, in accordance with at least one example of this disclosure.

FIG. 6 illustrates a front isometric view of a pump 618 and a pump mount 620, in accordance with at least one example of this disclosure. The pump 618 and the pump mount 620 can be similar to the pump 118 and 120 discussed above, except that the pump mount 620 can include a portion suspended from the pump manifold 624. Any of the previous enclosures can be modified to include such a pump and pump mount.

FIG. 6 shows how a rotating bracket 634 can be suspended from a pump manifold 624 by arms 678*a* and 678*b*, such that a center of gravity of the pump 618 is below an axis of rotation A (a center of the pump manifold 624). Such placement of the pump 618 can help promote movement of the pump about the axis of rotation when the enclosure to which a stationary bracket 632 is fixed. Arms 638*a* and 638*b* can include bores therethrough to receive the pump manifold 624 therethrough to create a bearing to allow the pump manifold 624 to rotate with respect to the stationary bracket 632.

FIG. 6 also shows a rotating manifold 668, which can be fluidly connected to the pump manifold 624 and to a discharge line 672 and a suction line 674 to connect the pump manifold 624 the discharge line 672 and the suction line 674 to effectively connect the pump 618 to the discharge line 672 and the suction line 674. The rotating manifold 668 can be secured to the pump manifold 624 using a bolt 670 that can be securable to a threaded portion 676 of the pump manifold 624. The rotating manifold 668 can be configured to connect to suction and discharge ports of the pump manifold 624 to allow for the pump manifold 624 to rotate with respect to the discharge line 672 and the suction line 674 without breaking the fluid connection between the discharge line 672 and the suction line 674 and the pump 618.

Figure 7:
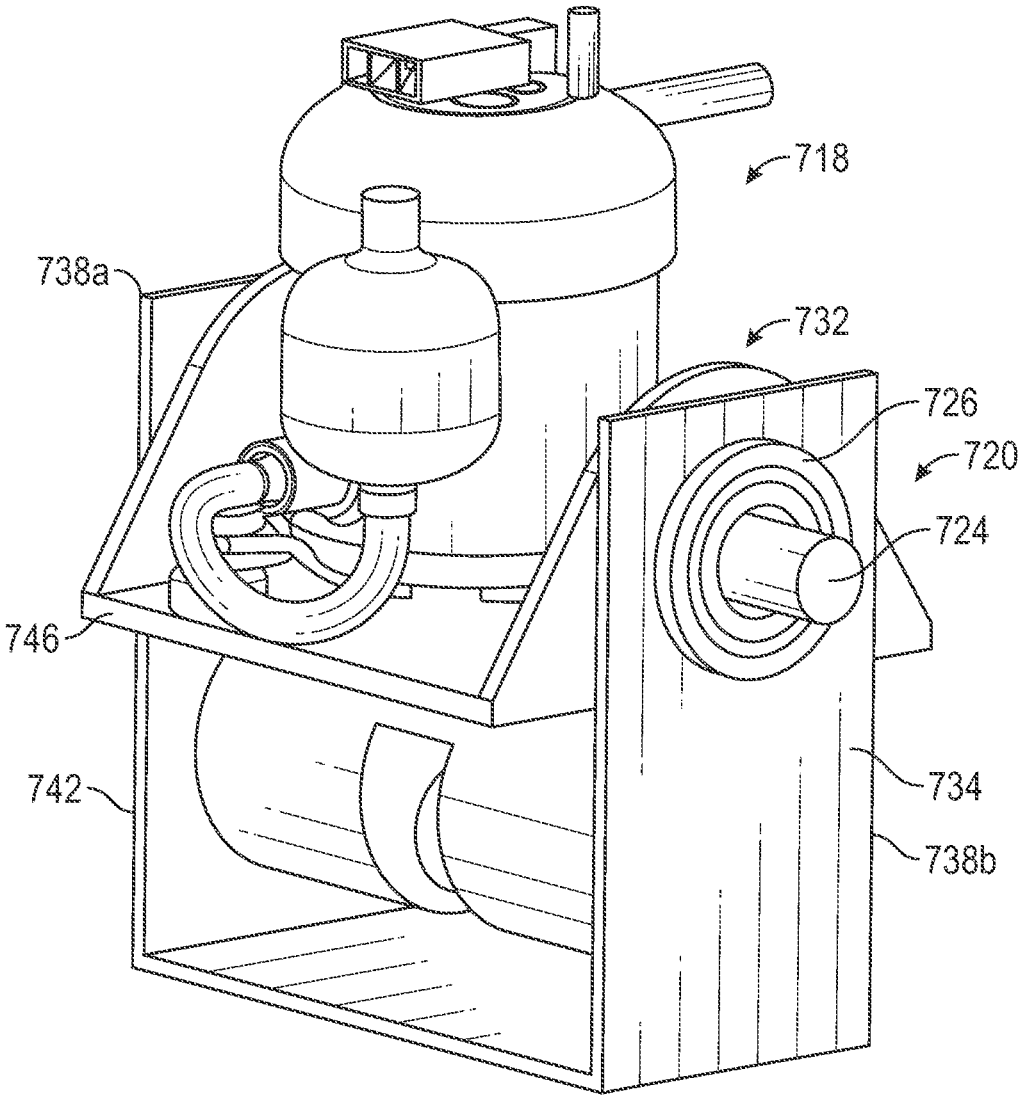
FIG. 7 illustrates a front isometric view of a pump and a pump mount, in accordance with at least one example of this disclosure.

FIG. 7 illustrates a front isometric view of a pump 718 and a pump mount 720, in accordance with at least one example of this disclosure. The pump 718 and the pump mount 720 can be similar to the pump 118 and 120 discussed above, except that the pump mount 720 can forego a race and wheel, which can help reduce a footprint of the stationary bracket 734. Any of the previous enclosures can be modified to include such a pump and pump mount.

In such an arrangement, arms 738*a* and 738*b* can extend upward to form a rotational support for a pump manifold 724. Bearings 726 can be secured to the arms 738. A platform 746 can be positioned below the pump manifold and a counterbalance can be suspended from a bottom portion of the platform 746.

Figure 8:
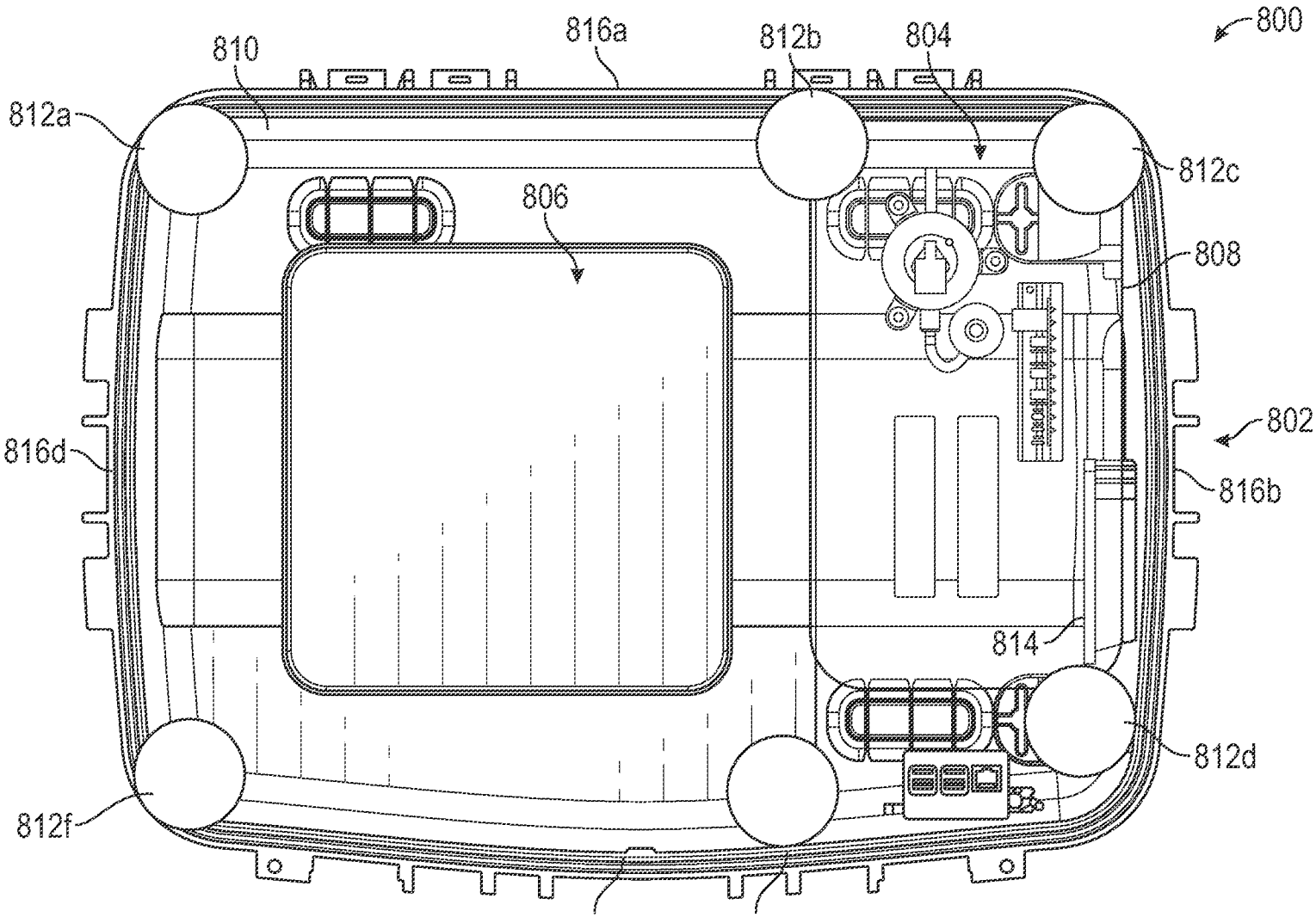
FIG. 8 illustrates a top view of a transportation enclosure, in accordance with at least one example of this disclosure.

FIG. 8 illustrates a top view of a transportation enclosure 800, in accordance with at least one example of this disclosure. The transportation enclosure 800 can be similar to the transportation enclosures discussed above, except FIG. 8 shows that the transportation enclosure 800 can include a product enclosure, a cooling system enclosure, and supports. Any of the previous enclosures can be modified to include such enclosures and supports.

The transportation enclosure 800 can include a housing 802, a cooling system 804, a product carrier 806, a cooling system enclosure 808, a product enclosure 810, supports 812*a*-812*f*, and a condenser fan 814. The housing 802 can include walls 816*a*-816*d*.

The cooling system enclosure 808 and the product enclosure 810 can be rigid or semi-rigid enclosures. The cooling system enclosure 808 can be sized and shaped to be positioned within the housing 802 and sized and shaped to enclose components of the cooling system 804. In some examples, the cooling system enclosure 808 can be configured to limit heat transfer between components of the cooling system and other components within the housing 802, such as components within the product carrier 806. The product enclosure 810 can be sized and shaped to be positioned within the housing 802 and sized and shaped to enclose the product carrier 806 and therefore products within the product carrier 806. In some examples, the product enclosure 810 can be configured to limit heat transfer between components of the product carrier 806 and other components within the housing 802, such as components within the cooling system enclosure 808.

The fan 814 can be one or more fans or pumps configured to motivate air to flow. The fan 814 can be an axial fan, a centrifugal (plug) fan, or the like and can be located adjacent to an opening in the housing 802 to connect the fan 814 to an ambient environment. In other examples, the fan 814 can be in other positions housing 802. The cooling system 804 can include an evaporator fan in some examples. One or more fans can be used in series or parallel flow configurations.

The supports 812*a*-812*e* can be rigid or semi-rigid supports or columns positioned between walls 816 of the housing 802 and the product enclosure 810 and/or the housing 802 and the cooling system enclosure 808. In some examples, the supports 812, (such as the support 812*b*) can be positioned between the housing 802 and both the cooling system enclosure 808 and the product enclosure 810.

The supports 812 can be positioned to engage the walls 816, the product enclosure 810, and the cooling system enclosure 808 to absorb shock and forces applied to the housing 802, helping to limit transmission of the shock and forces to the products within the carrier 806 and the components of the cooling system 804.

Figure 9:
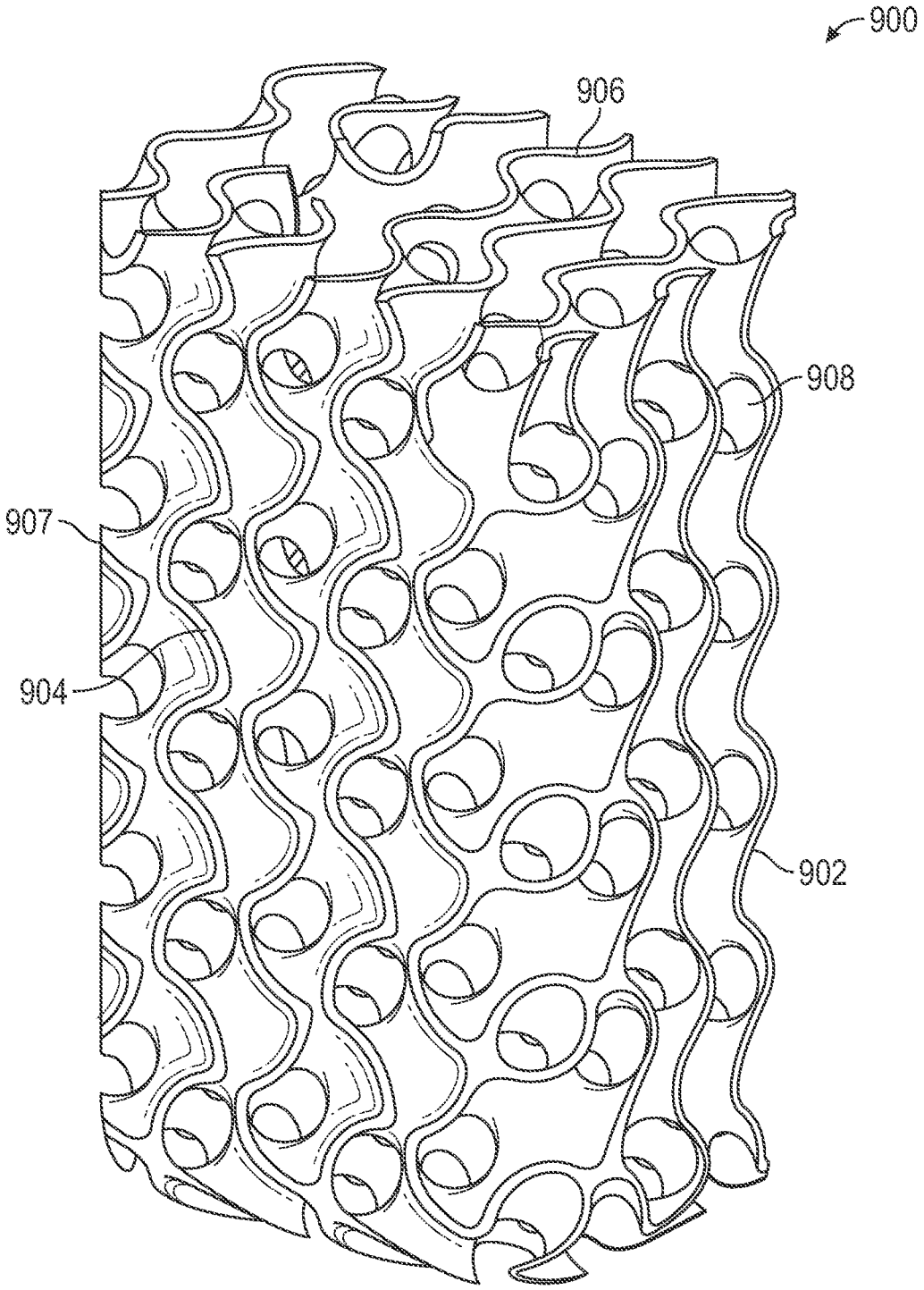
FIG. 9 illustrates an isometric view of a support for a transportation enclosure, in accordance with at least one example of this disclosure.

FIG. 9 illustrates an isometric view of a support 900 for a transportation enclosure, in accordance with at least one example of this disclosure. The support 900 can be the same as the supports 812; FIG. 9 shows structural details of the support 900.

The support 900 can include vertical corrugations 904, horizontal corrugations 902, transverse corrugations 906, lateral corrugations 907, and through holes 902. The support 900 can have a shape substantially consistent with a gyroid, which can provide a portion of an "infinite" periodic minimal surface without self-intersection. That is, the support 900 can include or be comprised of layered and substantially parallel ribbons or wavy or undulating corrugations that do not intersect themselves or parallel ribbons. That is, vertical parallel ribbons do not intersect themselves or each other, horizontal parallel ribbons do not intersect themselves or each other, and lateral parallel ribbons do not intersect themselves or each other; however, ribbons from transverse or non-parallel groups of ribbons may meet at certain points.

The shape of the support 900 in some examples can be a triply periodic minimal surface. In some examples, the shape of the support 900 can be defined by the equation sin x*cos y+Sin y*cos z+sin z*cos x=0. In some examples, the support 900 can have a shape of a Lidinoid. In other examples, the support 900 can have any shape of the Schwarz P, Schwarz D, Schwarz H, or Schwarz crossed layers of parallels (CLP) surfaces.

By having such a shape, the support 900 can be configured to promote a natural flow of air through the support 900, which can help improve cooling of components within a housing (such as the housing 802). Further, the shape of the support 900 and the interconnections between the layers or ribbons can help maintain a relatively high strength or ability to absorb shock and forces while providing flow paths for cooling.

NOTES AND EXAMPLES

The following, non-limiting examples, detail certain aspects of the present subject matter to solve the challenges and provide the benefits discussed herein, among others.

Example 1 is a product transportation and storage enclosure comprising: a housing including walls having a thickness, the housing configured to receive a product therein; a cooling system located within the housing and comprising: a cooling coil; a heat rejection coil connected to the cooling coil; and a pump connected to the cooling coil and the heat rejection coil; and a pump mount comprising: a stationary bracket secured to one or more of the walls of the housing; a rotating bracket configured to support the pump; a pump manifold connected to the stationary bracket and fluidly connected to the pump; and a rotating manifold supported by the pump manifold, the rotating manifold fluidly connecting the pump manifold to the cooling coil and the heat rejection coil, the pump, rotating bracket, and pump manifold rotatable relative to the stationary bracket and the rotating manifold.

In Example 2, the subject matter of Example 1 includes, a discharge line connecting the rotating manifold to the heat rejection coil; and a suction line connecting the rotating manifold to the cooling coil.

In Example 3, the subject matter of Examples 1-2 includes, wherein the stationary bracket includes a first arm including a first bore and a second arm including a second bore substantially coaxial with the first bore and a rotational axis, the pump manifold extending through the first bore and the second bore to form a rotating bearing such that the pump, rotating bracket, and pump manifold are rotatable about the rotational axis via the rotating bearing.

In Example 4, the subject matter of Example 3 includes, wherein the pump manifold includes a suction bore extending through at least a portion of the pump manifold and is connected to a suction line of the pump, and wherein the discharge bore extending through at least a portion the pump manifold and is connected to a discharge line of the pump, the discharge bore fluidly isolated from the suction bore within the pump manifold.

In Example 5, the subject matter of Example 4 includes, a suction port connected to the suction bore and a suction portion of the rotating manifold; and a discharge port connected to the discharge bore and a discharge portion of the rotating manifold.

In Example 6, the subject matter of Examples 4-5 includes, an integrated manifold supported by the rotating bracket and fluidly connected to the suction bore and the discharge bore.

In Example 7, the subject matter of Examples 5-6 includes, a plug connected to an end of the pump manifold to limit flow through the end of the pump manifold and to promote flow through the suction port and the discharge port.

In Example 8, the subject matter of Examples 3-7 includes, wherein the rotating bracket further comprises: a platform connected to the pump manifold, the pump securable to the platform.

In Example 9, the subject matter of Example 8 includes, wherein the pump is connected to the platform to position a center of mass of the pump below the rotational axis when the platform is in a resting position.

In Example 10, the subject matter of Examples 8-9 includes, wherein the rotating bracket further comprises: an overbalance connected to the platform to position a center of mass of the overbalance below the rotational axis when the platform is in a resting position.

In Example 11, the subject matter of Examples 8-10 includes, wherein the rotating bracket further comprises: a wheel connected to the platform and engageable with the stationary bracket to dampen movement of the rotating bracket relative to the stationary bracket.

In Example 12, the subject matter of Example 11 includes, wherein the stationary bracket further comprises: a race extending at least partially around the rotational axis and engageable with the wheel to dampen movement of the rotating bracket relative to the stationary bracket.

Example 13 is a pump mount for a product transportation and storage enclosure, the pump mount comprising: a stationary bracket secured to one or more of the walls of the housing; a rotating bracket configured to support the pump; a pump manifold connected to the stationary bracket and fluidly connected to the pump; and a rotating manifold supported by the pump manifold, the rotating manifold fluidly connecting the pump manifold to a first heat exchanger and a second heat exchanger, the pump, rotating bracket, and pump manifold rotatable relative to the stationary bracket and the rotating manifold.

Example 14 is a product transportation and storage enclosure comprising: a housing including walls defining a cavity; a cooling system located within the cavity and configured to cool one or more components within the housing; a cooling system enclosure located within the housing and configured to at least partially enclose the cooling system; a product enclosure located within the housing and configured to at least partially enclose a product within the housing; and a cooling system support in contact with the cooling system enclosure and at least one of the walls, the cooling system support having a shape of a of a periodic minimal surface.

In Example 15, the subject matter of Example 14 includes, a product support in contact with the product enclosure and at least one of the walls, the cooling system support having a shape of a periodic minimal surface.

In Example 16, the subject matter of Examples 14-15 includes, a common support in contact with the product enclosure, the cooling system enclosure, and at least one of the walls, the common support having a shape of a periodic minimal surface.

In Example 17, the subject matter of Examples 14-16 includes, wherein the shape of the cooling system support is a Schwarz surface.

In Example 18, the subject matter of Examples 14-17 includes, wherein the shape of the cooling system support is one of a P type, D type, H type, or CLP type Schwarz surface.

In Example 19, the subject matter of Examples 14-18 includes, wherein the shape of the cooling system support is a gyroid.

In Example 20, the subject matter of Examples 14-19 includes, wherein the cooling system further comprises: a first heat exchanger; a second heat exchanger connected to the first heat exchanger; and a pump connected to the first heat exchanger and the second heat exchanger.

In Example 21, the subject matter of Example 20 includes, a pump mount comprising: a stationary bracket secured to one or more of the walls of the housing; a rotating bracket configured to support the pump; a pump manifold connected to the stationary bracket and fluidly connected to the pump; and a rotating manifold supported by the pump manifold, the rotating manifold fluidly connecting the pump manifold to the first heat exchanger and the second heat exchanger, the pump, rotating bracket, and pump manifold rotatable relative to the stationary bracket and the rotating manifold.

Example 22 is at least one machine-readable medium including instructions that, when executed by processing circuitry, cause the processing circuitry to perform operations to implement of any of Examples 1-21.

Example 23 is an apparatus comprising means to implement of any of Examples 1-21.

Example 24 is a system to implement of any of Examples 1-21.

Example 25 is a method to implement of any of Examples 1-21.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A product transportation and storage enclosure comprising:

a housing including walls having a thickness, the housing configured to receive a product therein;

a cooling system located within the housing and comprising:

a cooling coil;

a heat rejection coil connected to the cooling coil; and a pump connected to the cooling coil and the heat rejection coil; and a pump mount comprising:

a stationary bracket secured to one or more of the walls of the housing;

a rotating bracket configured to support the pump;

a pump manifold connected to the stationary bracket and fluidly connected to the pump; and a rotating manifold supported by the pump manifold, the pump manifold fluidly connecting the rotating manifold to the cooling coil and the heat rejection coil, the pump, rotating bracket, and rotating manifold rotatable relative to the stationary bracket and the pump manifold.

2. The product transportation and storage enclosure of claim 1, further comprising:

a discharge line connecting the rotating manifold to the heat rejection coil; and a suction line connecting the rotating manifold to the cooling coil.

3. The product transportation and storage enclosure of claim 1, wherein the stationary bracket includes a first arm including a first bore and a second arm including a second bore substantially coaxial with the first bore and a rotational axis, the pump manifold extending through the first bore and the second bore to form a rotating bearing such that the pump, rotating bracket, and pump manifold are rotatable about the rotational axis via the rotating bearing.

4. The product transportation and storage enclosure of claim 3, wherein the pump manifold includes a suction bore extending through at least a portion of the pump manifold and is connected to a suction line of the pump, and wherein the discharge bore extending through at least a portion the pump manifold and is connected to a discharge line of the pump, the discharge bore fluidly isolated from the suction bore within the pump manifold.

5. The product transportation and storage enclosure of claim 4, further comprising:

a suction port connected to the suction bore and a suction portion of the rotating manifold; and a discharge port connected to the discharge bore and a discharge portion of the rotating manifold.

6. The product transportation and storage enclosure of claim 5, further comprising:

a plug connected to an end of the pump manifold to limit flow through the end of the pump manifold and to promote flow through the suction port and the discharge port.

7. The product transportation and storage enclosure of claim 4, further comprising:

an integrated manifold supported by the rotating bracket and fluidly connected to the suction bore and the discharge bore.

8. The product transportation and storage enclosure of claim 3, wherein the rotating bracket further comprises:

a platform connected to the pump manifold, the pump securable to the platform.

9. The product transportation and storage enclosure of claim 8, wherein the pump is connected to the platform to position a center of mass of the pump below the rotational axis when the platform is in a resting position.

10. The product transportation and storage enclosure of claim 8, wherein the rotating bracket further comprises:

an overbalance connected to the platform to position a center of mass of the overbalance below the rotational axis when the platform is in a resting position.

11. The product transportation and storage enclosure of claim 8, wherein the rotating bracket further comprises:

a wheel connected to the platform and engageable with the stationary bracket to dampen movement of the rotating bracket relative to the stationary bracket.

12. The product transportation and storage enclosure of claim 11, wherein the stationary bracket further comprises:

a race extending at least partially around the rotational axis and engageable with the wheel to dampen movement of the rotating bracket relative to the stationary bracket.

* * * * *